United States Patent [19]

Ng et al.

[11] Patent Number: 5,055,175

[45] Date of Patent: Oct. 8, 1991

[54] UPGRADING CRUDE OIL EMULSIONS

[75] Inventors: Flora T. T. Ng, Waterloo; Sophia K. Tsakiri, Kitchener, both of Canada

[73] Assignee: University of Waterloo, Waterloo, Canada

[21] Appl. No.: 379,976

[22] Filed: Jul. 14, 1989

[30] Foreign Application Priority Data

Jul. 14, 1988 [GB] United Kingdom ..... 8816740

[51] Int. Cl.[5] ..... C10G 47/02

[52] U.S. Cl. ..... 208/112; 208/100; 208/102; 208/188; 208/243; 208/244; 208/254 H; 252/358

[58] Field of Search ..... 208/100, 102, 112, 188, 208/243, 244, 254 H; 252/358

[56] References Cited

U.S. PATENT DOCUMENTS

| | | | |
|---|---|---|---|
| 3,586,621 | 6/1971 | Pitchford et al. | 208/112 |
| 3,676,331 | 7/1972 | Pitchford | 208/112 |
| 3,930,984 | 1/1976 | Pitchford | 208/433 |
| 4,466,885 | 8/1984 | Ronden | 208/188 |
| 4,756,819 | 7/1988 | Bousquet et al. | 208/112 |

FOREIGN PATENT DOCUMENTS 59-75986 4/1984 Japan .

*Primary Examiner*—Curtis R. Davis
*Assistant Examiner*—William C. Diemler
*Attorney, Agent, or Firm*—Sim & McBurney

[57] ABSTRACT

Heavy crude oil emulsions are converted to lighter essentially sulphur-free and nitrogen-free hydrocarbons by Group VI B or Group VIII B metal compounds or complexes along with carbon monoxide, hydrogen or mixtures of carbon monoxide and hydrogen, and broken without the necessity for prior emulsion treatment and separation.

31 Claims, 1 Drawing Sheet

UPGRADING CRUDE OIL EMULSIONS

FIELD OF INVENTION

The present invention relates to the breaking and upgrading of heavy crude oil emulsions in a single stage process without the need of any prior emulsion treatment and/or separation. In the present invention, water commonly associated with the oil in the crude oil emulsion preferably is activated in the presence of certain metal compounds and carbon monoxide to produce hydrogen, which is further consumed for hydrocracking, hydrogenation, desulphurization and denitrogenation, so that essentially sulphur-free and nitrogen-free, and lower boiling hydrocarbons are formed.

BACKGROUND TO THE INVENTION

Heavy crude oils are recovered by injecting steam into the reservoir and heavy crude oil emulsions are recovered at well heads. These heavy crude oil emulsions are separated into an oil phase and a water phase by employing physical and/or electrostatic phase separation techniques with the aid of chemical demulsifiers. Heavy crude oils contain about 3 to 8 wt % sulphur and are significantly heavier than conventional lighter crude oils. Thus, upgrading of the oil is required prior to utilization of these crude oil resources in existing refineries. The term "upgrading" is used herein to designate a catalytic process in which the heavy hydrocarbons and coke precursors (as measured by the Conradson carbon residue) of the heavy crude oil emulsions are converted, at least in part, to lower boiling hydrocarbon products while simultaneously decreasing the concentration of sulphur, nitrogen and metallic contaminants present in the crude oil. Upgrading includes a number of processes, such as hydrocracking, hydrogenation, desulphurization, denitrogenation and demetallation.

The theoretical principles involved in one embodiment of the present invention are the activation of water via the so-called water-gas-shift reaction (that is, the reaction of $H_2O$ with CO to produce $H_2$ and $CO_2$) in the heavy crude oil emulsion to generate hydrogen in situ for upgrading purposes. These processes are effected by certain catalysts, as described in detail below. The catalysts or catalyst precursors employed herein refer to those substances which, when contacted with emulsion, produce hydrogen which reacts with heavy crude oil in the emulsion for upgrading purposes and/or which utilize hydrogen for upgrading heavy crude oil emulsion.

The water-gas-shift reaction is carried out industrially over heterogeneous catalysts comprising of metal oxides (See Newsome, D.S. Cat. Rev.-Sci. Eng., 21(2) 275-318 (1980)). Recently, homogeneous catalysts based on Group VI B and VIII B transition metal carbonyls (e.g., $Mo(CO)_6$, $W(CO)_6$, $Cr(CO)_6$, $Ru_3(CO)12$ and $Fe(CO)_5$) have been reported to be active for the water-gas shift reaction in aqueous alcoholic solutions. (See Laine, R. M. and Wilson, R. B., "Aspects of Homogeneous Catalysis", R. Ugo (ed), Vol. 5, p.216-240, D. Reidel Pub. Co., 1984). It is stated that polar solvents are required for the catalytic activity of these catalysts. (See Slegeir, W. A. R., Sapienza, R. S. and Easterling, B., "Catalytic Activation of Carbon Monoxide", ed. A.C.S. Symposium Series, 152, 1981, p. 325-343). However, in the present invention, we have discovered that certain metal complexes and compounds are effective for catalyzing the water-gas-shift reaction in non-polar hydrocarbon medium, as described further below.

One major reaction in the upgrading of crude oil is desulphurization. Sulphur is present in crude oil primarily in the form of organic compounds, such as thiols, sulphides, thiophenes and condensed heterocyclic compounds. Hydrodesulphurization is the removal of sulphur from hydrocarbon feedstocks by a catalytic reaction of sulphur compounds with molecular $H_2$ to give $H_2S$. The commercial hydrodesulphurization processes are heterogeneously catalyzed by Co, Mo, Ni and W oxides supported on acidic oxides, such as $\gamma 0$ -$Al_2O_3$ (See Vrinat, M. L. and De Mourges, L., Appl. Catal. 5, 43-57, 1983). These processes are carried out in fixed-bed, trickle, slurry and fluidized bed reactors at temperatures and pressures ranging between about 340° and about 425° C. and pressures of about 800 to about 2500 psia. Hydrodesulphurization of benzothiophene and dibenzothiophene in tetralin were achieved by co-feeding CO and $H_2O$ to a trickle bed reactor. A presulphided commercial Ni-Mo/$Al_2O_3$ was used. (See Kumar, M., Akgerman, A. and Anthony, R. G., Ind. Eng. Chem. Process Des. Dev. 23, 88-93 (1984); Hook, B. D. and Akgerman, A. Ind. Eng. Chem. Process Des. Dev. 25, 278-284 (1986)).

U.S. Pat. No. 3,676,331 describes a method and catalysts for the upgrading of hydrocarbons which comprises introducing water and a catalyst system containing at least two components into the hydrocarbon. At least one component of the catalyst system promotes the generation of hydrogen by reacting with water and another of the components is used in upgrading reactions. U.S. Pat. Nos. 4,134,825, 4,192,735 and 4,244,839 and German O.S. 2,729,552 teach that catalysts generated in situ in the feed are effective for upgrading hydrocarbons in the presence of externally-supplied hydrogen. Canadian Patent No. 1,183,098 teaches the hydrogenation of carbonaceous material by iron carbonyl, preferably $Fe_2(CO)_9$, in the presence of hydrogen and/or a mixture of carbon monoxide and hydrogen. U.S. Pat. No. 4,325,802 teaches the processing of coal by reacting CO and $H_2O$ with metal carbonyls or low valent complexes under alkaline conditions at sufficiently high temperatures and pressures to produce liquid hydrocarbons. However, none of the prior art refers to utilization of water present in the emulsion to achieve hydrogen generation for upgrading hydrocarbons and for emulsion breaking.

SUMMARY OF INVENTION

In accordance with one aspect of the present invention, there is provided a process for treating hydrocarbonaceous oil emulsions, which comprises reacting the hydrocarbonaceous oil emulsion with hydrogen in the presence of at least one compound or complex of a metal of Group VI B and Group VIII B of the Periodic Table of Elements so as to effect breaking of the emulsion into an aqueous phase and an oil phase.

In one embodiment of the invention, the process comprises (a) forming a mixture of heavy crude oil emulsion and an added metal compound or complex, in an amount ranging from about 50 to about 22,500 weight parts per million, calculated as elemental metal, based on the weight of the heavy crude oil emulsion. The metal compounds or complexes are selected from Group VI B and VIII B Elements of the Periodic Table. (b) The mixture is processed with CO, $H_2$ or mixtures of $H_2$ and CO, such as synthesis gas, and (c) the mixture and gases are heated to reaction temperature. (d) The metal compound or complex is converted to an active catalytic species within the mixture, under the reaction conditions, while (e) hydrogen is produced in situ e.g. via the water-gas-shift reaction, if CO atmosphere was used. (f) The heavy crude oil emulsion is broken into an aqueous and oil phase, and (g) the in situ produced hydrogen or externally supplied hydrogen is utilized for upgrading crude oil into lower boiling hydrocarbons essentially free from sulphur and nitrogen.

In this embodiment of the invention, there is effected (a) production of hydrogen in situ from the water in the emulsion through catalytic processes, such as the water-gas-shift reaction, (b) utilization of this hydrogen for upgrading crude oil into essentially sulphur and nitrogen-free and lower boiling hydrocarbon products and (c) destabilization and separation of heavy crude oil into oil and water phases without adding deemulsifiers and utilization of conventional emulsion treatment units.

In accordance with another aspect of the present invention, there is provided a process for emulsion breaking, which comprises generating hydrogen in situ in an aqueous hydrocarbonaceous oil emulsion in the presence of at least one compound or complex of a metal of Group VI B and Group VIII B of the Periodic Table of Elements so as to effect breaking of the emulsion into an aqueous phase and an oil phase.

Hydrogen produced in situ, generally by the water-gas-shift reaction between carbon monoxide feed to the reaction vessel and the aqueous phase of the emulsion, is much more active than added hydrogen and such hydrogen not only effects emulsion breaking but particularly is available to effect further reactions, preferably upgrading of the oil.

When generating hydrogen in situ in this aspect of the present invention, it is preferred to employ, as the metal compound or complex, molybdenum or tungsten hexacarbonyl, phosphomolybdic acid or molybdenum naphthenate. This process generally is carried out at a temperature in the range of about 100° to about 400° C. and at a pressure of about 350 to about 4000 psig.

DETAILED DESCRIPTION OF INVENTION

Figure 1:
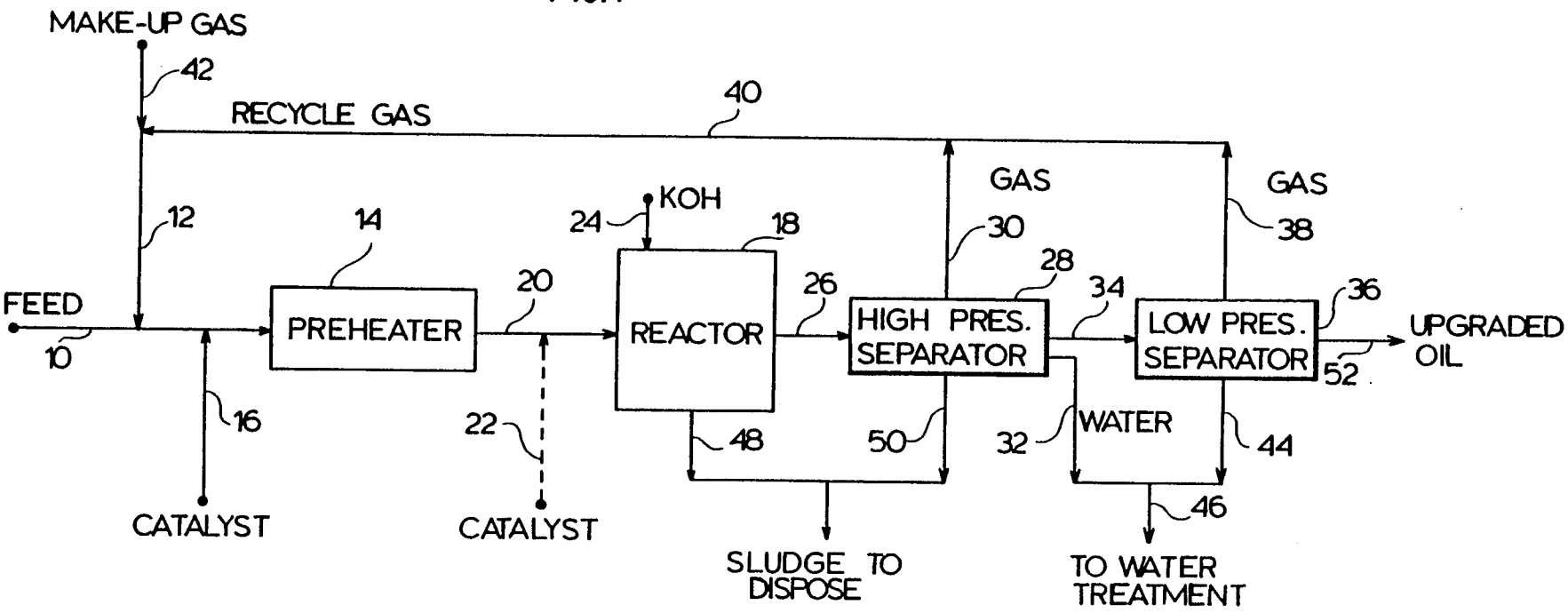
FIG. 1 shows schematically a flow sheet for an embodiment of the process of the present invention.

The present invention, in one aspect, relates to the upgrading of heavy crude oil emulsions. The process of the invention is intended to replace the presently-applied techniques for crude oil emulsion treatment and upgrading, which include addition of demulsifers together with physical and/or electrostatic phase separations, to separate emulsions into water and oil phases, followed by further upgrading of the oil phase, which suffer from (a) being multistage, (b) being expensive, as far as construction material and specialty chemicals are involved, and (c) requiring external hydrogen supply.

This invention is generally applicable to emulsified hydrocarbon and water mixtures. In particular, this invention is intended to be applied to catalytic treatment and upgrading of heavy crude oil emulsions, especially those with high water, sulphur and nitrogen contents. More specifically, the present invention uses a single stage process for the upgrading of crude oil emulsions, without the need of any prior emulsion treatment and/or separation.

In the present invention, this water, commonly associated with the oil in the crude oil emulsion, is activated, for example, by carbon monoxide in the presence of certain metal compounds or complexes, to produce hydrogen, which is further consumed, for hydrocracking, hydrogenation, hydrodesulphurization and hydrodenitrogenation processes, so that essentially sulphur-free and nitrogen-free and lower boiling hydrocarbon products are formed.

Heavy and sour crude oils and bitumen reservoirs are usually of high sulphur content, usually in the range of about 3 to about 8 wt. %, and declining producing wells tend to produce more water with time, which ranges from a few to about 90 weight percent. This water is highly saline and causes many operational problems, due to its scaling, corrosive and chemically-incompatible characteristics. The crude oil may be of any chemical composition and generally contains paraffinic, naphthenic and aromatic hydrocarbons, together with heterocyclic species containing sulphur and nitrogen. The present invention may be applied to emulsions derived from heavy oil well-head bitumen, heavy oil slop feed, asphaltenes, refinery atmospheric and vacuum distillation residue and synthetic hydrocarbon/water emulsions, for example, resulting from oil spills.

In general, the oil content of the emulsions treated in accordance with the process of the invention may range from about 2 to about 98 wt. % of the emulsion, preferably about 10 to about 80 wt. % of the emulsion. Water contained in the emulsion may be saline or sweet, including naturally-occurring saline water in petroleum reservoirs and sweet well and spring waters. The emulsions treated in the present invention may contain natural emulsifiers, such as resins, esters and polyglycols.

The upgrading process of the present invention is carried out under alkaline conditions, when certain catalysts, such as metal carbonyls, are employed. Alkaline pH conditions, when not naturally present, may be achieved by the use of potassium hydroxide, most conveniently as an aqueous solution thereof having a concentration of about 0.1 to about 2 molar, preferably about 0.5 to 1 molar.

Sulphur content may vary from traces to about 8 weight percent. Sulphur may be present as an element, in the form of thiophene or condensed thiophenes, such as thiophene, benzothiophene and dibenzothiophene, or in the form of mercaptans or thiols, sulphides, disulphides, sulphoxides or sulphones. Nitrogen may vary from traces up to about 5 weight percent. Nitrogen may be present in the form of heterocyclic aromatic compounds, such as quinoline, acridine and in porphyrin rings.

The catalyst system employed in the present invention is homogeneous, generally based on Groups VI B and VIII B metal compounds or complexes, which are transformed into the desired active species under the process conditions. The same process also may be carried out using heterogeneous catalysts, for example, some Group VI B and VIII B metals or metal complexes on, for example, Si/Al or Al supports, in a fixed bed, trickle bed or fluidized bed reactor.

In one embodiment of the invention, a metal complex or compound is added to the hydrocarbonaceous oil emulsion referred to as feed. The metal content in the feed varies from about 50 to about 22,500 wppm (weight part per million of feed), preferably from about 2,500 to about 5,500 wppm. Suitable metal compounds, convertible to active catalytic species under the process conditions, include (1) inorganic metal compounds, such as heteropoly acids, for example, phosphomolybdic acid or molybdic acid; (2) metal salts of organic acids, for example, naphthenic acids; (3) metal carbonyls, for example, tungsten hexacarbonyl and molybdenum hexacarbonyl; (4) metal inorganic salts, for example, iron sulphate heptahydrate; (5) salts of inorganic acids, for example, ammonium molybdate; and (6) metal oxides, for example, molybdenum oxide. The metal constituent of the metal compound or complex is selected from Groups VI B and VIII B of the Periodic Table of Elements, the preferred metal constituent being selected from Group VI B of the Periodic Table of Elements. Particularly useful metals as the metal constituent of the catalyst are molybdenum, tungsten and iron. Preferred compounds of these metals are molybdenum hexacarbonyl, molybdenum naphthenate, tungsten hexacarbonyl and iron sulphate heptahydrate. One more preferred type of metal compound is a heteropoly acid, for example, phosphomolybdic acid. Molybdic acid also may be used.

The added metal compound is dispersed or dissolved into the hydrocarbonaceous oil emulsion and is kept in dispersion or solution in a batch autoclave by means of a mechanical stirrer. The conversion of the added metal compound into active catalytic species occurs under the process conditions, without the need of additional pretreatment. The catalyst of the present invention is used as a sole catalyst for catalyzing the water-gas-shift and upgrading reactions. The catalytic effect of the reactor walls was found to be minimal compared to the effectiveness of the metal compounds or complexes.

The process generally is carried out at a temperature ranging from about 300° C. to about 450° C., preferably from about 310° C. to about 360° C. The reaction total pressure generally ranges from about 1,500 psig to about 5,000 psig, preferably from 850 psig to about 2,000 psig. Reaction times of about half an hour to several hours may be used, preferably from about 1.5 hr. to about 2.5 hr. Where carbon monoxide is employed, an initial loading of about 200 to about 1,000 psig is generally employed.

The catalytic solids derived from metal compounds and complexes may be separated from the products by conventional means, for example, settling, filtering, centrifuging and distillation. A portion of the catalytic solids may be recycled. The process of the invention may be conducted either as a batch or as a continuous operation.

The process of the present invention breaks the initial emulsion into two phases, namely an oil phase and an aqueous phase and this emulsion breaking is effected without the aid of chemicals, such as surfactants or demulsifiers, or any prior treatment. The phases then can be readily recovered.

DESCRIPTION OF PREFERRED EMBODIMENT

Referring to the drawing, a crude oil emulsion in line 10 is mixed with recycle gas in line 12 and is forwarded to a preheater 14. Where a homogeneous catalyst system is used, the catalyst is introduced by line 16 to the crude oil emulsion in line 10 prior to the preheater 14. Alternatively, the homogeneous catalyst may be added by line 22 to the heated crude oil emulsion in line 20 prior to reactor 18.

The reaction mixture, preheated to the desired reaction temperature, is forwarded to a reactor 18 by line 20. Where the catalyst employed in the reaction is a heterogenous one, it is introduced to reactor 18 prior to the start up of the process. As required, the basicity of the reaction mixture in the reactor 18 is adjusted to alkaline by the addition of potassium hydroxide solution by line 24.

In the reactor 18, the emulsion is subjected to conditions of high temperature and pressure under an activating atmosphere provided by the gases in line 12, typically carbon monoxide, hydrogen and synthesis gas. Within the reactor, the water may undergo the water-gas-shift reaction, producing hydrogen, which then effects hydrotreatment and upgrading of the other hydrocarbonaceous components and emulsion breaking. Alternatively, the externally supplied hydrogen also can be activated by certain metal compounds or complexes for hydrotreatment and upgrading of the hydrocarbonaceous component and emulsion breaking.

The products of reaction are forwarded by line 26 to a high pressure separator 28, wherein gas is separated by line 30 for recycle, water is separated by line 32 for forwarding to a water treatment process and separated oil is forwarded by line 34 to a low pressure separator 36. In the low pressure separator 36, further gas and water separation occurs, gas being vented by line 38 to join with the gas in line 30 as a recycle gas stream in line 40. Make-up gas is added by line 42 to the recycle gas stream in line 40 to provide the gas feed in line 12.

Further water is removed by line 44 to join with the water in line 32 to provide a combined feed in line 46 for further water treatment. Any sludge which may be formed in the reactor 18 or the high pressure separator 28 may be removed respectively by lines 48 and 50 for disposal.

Upgraded oil produced from the initial emulsion by the process is recovered as product, in the form of essentially sulphur- and nitrogen-free lower boiling hydrocarbon materials, from the low pressure separator 36 by line 52.

EXAMPLES

Detailed studies of the emulsion-upgrading process described above with respect to FIG. 1 have been performed in a 300 ml SS 316 Autoclave Engineers stirred batch autoclave. Results obtained from experiments using a glass liner have shown that the vessel wall had little contribution to the observed catalytic effect. Subsequent experiments were carried out without a glass liner. In general, a simulated emulsion of the following composition was studied:

| | |
|---|---|
| Toluene | 50 to 75 wt. % |
| Benzothiophene or Dibenzothiophene | 10 to 20 wt. % (2.2 to 4.4 wt. % sulphur) |
| Quinoline | 10 to 30 wt. % (0.9 to 2.5 wt. % nitrogen) |
| Water | 15 to 30 wt. % |
| Emulsifier | 0.1 to 1 wt. % |

The emulsifier used was based on non-ionic surfactant, such as ethylene/propylene oxides. Emulsification was achieved by hand shaking. The applied reaction conditions were varied in the experiments within the following ranges:

| | |
|---|---|
| Temperature | 180° C. to 340° C. |
| Pressure | 1500 psig to 2700 psig |
| Atmosphere | Carbon Monoxide, Hydrogen |

-continued

| |
|---|
| and Nitrogen |

At the end of the experiment, the volume of gaseous product and weight of liquid product were determined. The gaseous and liquid products were analyzed by gas chromatographic techniques. The hydrogen partial pressure was estimated from the $CO_2$ content in gaseous products determined from gas chromatographic techniques the total volume of gaseous products collected. The water-gas-shift reaction Eq. (1)

$$CO+H_2O \rightleftharpoons CO_2+H_2 \quad (1)$$

produces equal number of moles of $H_2$ and $CO_2$. Since hydrogen is consumed during the reaction for upgrading purposes, the amount of $CO_2$ determined approximates the amount of $H_2$ produced. Sulphur removal was calculated based on the moles of ethylbenzene produced with respect to the initial moles of benzothiophene in the feed, the feed being the total emulsion. $H_2S$ production was detected by gas chromatographic technique and is reported as mmol of $H_2S$, produced per mmol of benzothiophene in the total emulsion.

EXAMPLE 1

Experiments were performed with a toluene/water emulsion containing benzothiophene. The benzothiophene content in the emulsion was equivalent to 3.5 wt. % sulphur. The toluene to water volume ratio was 3:1. Phosphomolybdic acid (PMA) was used as catalyst precursor. The effect of PMA concentration on sulphur removal is summarized in Table 1 below. Comparison of runs 2 and 3 with run 1 (the control experiment, with no added PMA) shows that increasing PMA concentration results in an increase in hydrogen production in situ via the water-gas shift reaction and an increase in sulphur removal.

TABLE 1

Effect of PMA Concentration on The Upgrading of Benzothiophene in Toluene/Water Emulsion
The initial CO loading pressure at room temperature was 300 psig. The reaction was carried out at 340° C. for 2.5 hours.

| | RUNS | | |
|---|---|---|---|
| | 1 | 2 | 3 |
| PMA, wppm Mo | 0 | 5,537 | 22,145 |
| Reaction pressure at 340° C., psig | 1,670 | 1,790 | 2,070 |
| $H_2$ partial pressure at reaction condition, psig | 330 | 880 | 1,300 |
| $H_2$ consumption mmol/mmol benzothiophene | 0.288 | 1.44 | 1.57 |
| Sulphur removal, wt. % | 2.9 | 45.4 | 76.2 |
| $H_2S$ production, mmol/mmol benzothiophene | 0 | 0.17 | 0.20 |
| Emulsion breaking | Yes | Yes | Yes |

These results show that desulphurization, hydrogenation and hydrocracking occurred since $H_2S$ and ethylbenzene were detected in the product. The emulsion broke into two distinct oil and water phases.

EXAMPLE 2

Experiments were carried out with a benzothiophene emulsion with the same composition as in Example 1. The effect of varying initial CO loading pressures was studied. The results of these experiments are summarized in Table 2 below.

TABLE 2

The Effect of the CO Loading Pressure On The Upgrading of Benzothiophene Emulsion with PMA
The reaction was carried out at 340° C. for 2.5 hours in the presence of 5,537 wppm Mo.

| | RUNS | | |
|---|---|---|---|
| | 1 | 2 | 3 |
| Initial CO loading pressure, psig | 300 | 450 | 600 |
| Reaction pressure at 340° C. | 1,790 | 2,550 | 2,740 |
| $H_2$ partial pressure at reaction condition, psig | 890 | 1,210 | 1,750 |
| $H_2$ consumption mmol/mmol benzothiophene | 1.44 | 1.62 | 2.98 |
| Sulphur removal, wt. % | 45.4 | 47.5 | 94.6 |
| $H_2S$ production, mmol/mmol benzothiophene | 0.17 | 0.54 | 0.49 |
| Emulsion breaking | Yes | Yes | Yes |

The results obtained show that the in situ hydrogen production and sulphur removal increased with increasing CO loading pressure. The emulsion was clearly broken into two distinct oil and water phases.

EXAMPLE 3

Experiments were performed with a benzothiophene emulsion with the same composition as in Example 1 with PMA. Hydrogen was externally supplied at the beginning of the experiment, instead of CO, to evaluate the activity of the in situ produced hydrogen vs. the activity of the externally supplied hydrogen. The results of these experiments are summarized in Table 3 below.

TABLE 3

Effect of In Situ Generated $H_2$ vs. Externally Supplied $H_2$ with PMA
The reaction were carried out for 2.5 hours and 5,537 wppm Mo.

| | RUNS | |
|---|---|---|
| | 1 | 2 |
| Reactant gas | $H_2$ | CO |
| Initial loading pressure, psig | 400 | 600 |
| Reaction pressure at 340° C. | 2,165 | 2,740 |
| $H_2$ partial pressure at reaction condition, psig | 1,800 | 1,750 |
| $H_2$ consumption, mmol/mmol benzothiophene | 1.52 | 2.94 |
| Sulphur removal, wt. % | 45.1 | 94.6 |
| $H_2S$ production, mmol/mmol benzothiophene | 0.09 | 0.49 |
| Emulsion breaking | Yes | Yes |

Comparison of run 2 with run 1 shows that the in situ produced hydrogen, at approximately the same partial pressure as in the case of externally-supplied hydrogen, is about two times more effective for sulphur removal. The emulsion was also broken into two distinct oil and water phases both with externally supplied $H_2$ and in situ produced $H_2$.

EXAMPLE 4

Experiments were carried out with a benzothiophene emulsion with the same composition as in Example 1 in the presence of $Mo(CO)_6$ under CO, $H_2$ and $N_2$ atmosphere respectively. Table 4 below summarizes the results of these experiments.

TABLE 4

Effect of Different Gaseous Atmospheres on Emulsion Breaking And Upgrading with 510 wppm Mo as $Mo(CO)_6$ The reactions were carried out at 310° C. for 2.5 hours with 53.6 mmol KOH[1]

| | RUNS | | |
|---|---|---|---|
| | 1 | 2 | 3 |
| Reactant gas | CO | $H_2$ | $N_2$ |
| Initial loading pressure at room temperature, psig | 300 | 300 | 1,900 |
| Reaction pressure at 310° C. | 1,970 | 1,960 | 1,900 |
| $H_2$ partial pressure at reaction condition, psig | 980 | 1,500 | 0.0 |
| Sulphur removal, wt. % | 6.3 | 0.0 | 0.0 |
| Emulsion breaking | Yes | No | No |

[1]KOH is required for the generation of $H_2$ in situ via the water-gas shift reaction with $Mo(CO)_6$.

These results show that the in situ generated $H_2$ from the water-gas-shift reaction is effective for both emulsion breaking and upgrading, measured in terms of sulphur removal. In the case of externally supplied $H_2$, no emulsion breaking or upgrading was observed. Therefore, it can be concluded that the in situ produced $H_2$ is more active than the externally supplied $H_2$.

The experiment carried out under $N_2$ atmosphere shows neither emulsion breaking or sulphur removal. These results show that thermal cracking or aquathermolysis (reactions of water/steam with hydrocarbonaceous materials at high temperature and high pressure) do not occur to any measurable extent under these reaction conditions. Therefore, these runs demonstrate that activation of water to produce $H_2$ via the water-gas-shift reaction is necessary for emulsion breaking with $Mo(CO)_6$ in an alkaline emulsion feed.

EXAMPLE 5

In this experiment, dibenzothiophene was used as a sulphur substrate in a toluene/water (3:1 volume ratio) emulsion. The dibenzothiophene content in the emulsion was equivalent to 2.2 wt% sulphur. PMA was used as catalyst precursor. The experiment was carried out at 340° C. for 2.5 hours, with an initial CO loading pressure of 450 psig and 5,537 wppm Mo. Biphenyl was identified as the major product. A 3.9 wt. % sulphur removal was achieved based on the biphenyl produced with respect to initial dibenzothiophene concentration. Complete emulsion breaking to two distinct oil and water phases was observed.

EXAMPLE 6

In this experiment, quinoline was used as a nitrogen substrate in a toluene/water (3:1 volume ratio) emulsion. The quinoline content in the emulsion was equivalent to 2.2 wt. % $N_2$. PMA was used as catalyst precursor. The experiment was carried out at 340° C. for 2.5 hours, with a CO loading pressure of 600 psig and 5,537 wppm Mo. The major denitrogenation product is propylbenzene. A 1.8 wt. % nitrogen removal based on the propylbenzene production with respect to the initial amount of quinoline was obtained. Complete emulsion breaking into two distinct oil and water phases was obtained.

EXAMPLE 7

Experiments were performed with well head bitumen and slop oil from Alberta. These samples contained water tightly emulsified with the oil phase as shown by microscopic examination. These materials were processed under CO atmosphere with an initial CO loading pressure of 300 psig and approximately 6,300 ppm molybdenum supplied as $Mo(CO)_6$ and 1M KOH. $H_2S$ was detected in the gaseous phase indicating hydrodesulphurization. Viscosity of the liquid product was lower than the feed. Microscopic examination of the liquid product showed the absence of water, indicating that the emulsion was broken. Table 5 below summarizes the reaction conditions and results obtained.

TABLE 5

Upgrading of Slop Oil and Bitumen with CO and $Mo(CO)_6$

| | RUNS | |
|---|---|---|
| | 1 | 2 |
| Feed | Slop Oil | Well Head Bitumen |
| Reaction temperature, °C. | 310 | 340 |
| Reaction pressure, psig | 1,930 | 2,640 |
| $H_2$ partial pressure | 930 | 1,245 |
| $H_2S$, mmol/mmol catalyst/day | 9.76 | 3.6 |

EXAMPLE 8

A sample of well head bitumen containing 30 volume % water was processed under CO at an initial CO loading pressure of 450 psig for 2.5 hours with 6,311 wppm Mo, supplied as PMA. At reaction conditions, the total pressure was 2,360 psig and the hydrogen partial pressure was 890 psig. $H_2S$ was detected in the gaseous phase. Complete emulsion breaking was observed based on microscopic examination. The viscosity and density of the liquid product were lower than that of the feed.

EXAMPLE 9

Experiments were performed with a toluene/water (3:1 volume %) emulsion to investigate hydrogen production through the water-gas shift reaction in a non-polar solvent system containing solutions or dispersions of metal compounds. Table 6 below summarizes the results:

TABLE 6

The Water-Gas/Shift Reaction in a Non-Polar Solvent System With Different Metal Compounds in CO Atmosphere The emulsion contains 3:1 vol ratio of toluene:water

| | RUNS | | | |
|---|---|---|---|---|
| | 1 | 2 | 3 | 4[a] |
| Initial loading pressure at room temperature, psig | 300 | 300 | 300 | 450 |
| KOH; mmol | 71.43 | 71.43 | 71.43 | none |
| Metal compound | none | $Mo(CO)_6$ | $W(CO)_6$ | PMA |
| wwpm | 0 | 5,865 | 750 | 5,955 |
| Reaction temperature, °C. | 180 | 180 | 180 | 180 |
| Reaction pressure, psig | 468 | 450 | 458 | 805 |
| $H_2$, mmol | 3.9 | 9.8 | 7.8 | 5.2 |
| HTN[b] | NA | 250 | 264 | 182 |

| | RUNS | | | |
|---|---|---|---|---|
| | 5[a] | 6 | 7 | 8[a] |
| Initial loading pressure at room temperature, psig | 300 | 450 | 300 | 300 |
| KOH, mmol | none | none | 71.43 | 71.43 |
| Metal compound | none | PMA | $Mo(CO)_6$ | Mo-Napthenate |
| wwpm | 0 | 6,460 | 5,865 | 11,466 |
| Reaction temperature, °C. | 340 | 340 | 340 | 340 |

TABLE 6-continued

The Water-Gas/Shift Reaction in a Non-Polar Solvent System With Different Metal Compounds in CO Atmosphere
The emulsion contains 3:1 vol ratio of toluene:water

| | | | | |
|---|---|---|---|---|
| Reaction pressure, psig | 1,662 | 2,658 | 2,328 | 2,273 |
| $H_2$, mmol | 27.3 | 81 | 129 | 120 |
| HTN[b] | NA | 2,840 | 3,280 | 208 |

[a]emulsion containing benzothiophene
[b]hydrogen turnover no = mmol $H_2$/mmol metal compound/day
NA = not applicable At 340° C., significant quantities of hydrogen were produced using $Mo(CO)_6$ and $W(CO)_6$ and alkaline medium containing KOH was found to be required for the water-gas shift reaction to occur. No alkaline is required for the water-gas-shift reaction to occur when phosphomolybdic acid was used. Non-polar solvents, such as xylene, decane, decalin etc., also were found to generate hydrogen in the presence of $Mo(CO)_6$ in an alkaline medium. In all these cases, the emulsion broke into two distinct oil and water phases.

EXAMPLE 10

Experiments were carried out with a benzothiophene emulsion with the same composition as in Example 1 using ammonium molybdate and molybdic acid. Results of these experiments are summarized in Table 7 below.

TABLE 7

The Effect of Different Catalysts On the Upgrading of Benzothiophene in Toluene/Water Emulsion
The reaction was carried out at 340° C. for 2.5 hours at 600 psig initial CO Loading Pressure

| | RUNS | | |
|---|---|---|---|
| | 1 | 2 | 3 |
| Metal Compound | PMA | Ammonim Molybdate | Molybdic Acid |
| (wppm) | (5,537) | (6,000) | (6,000) |
| Reaction Pressure at 340° C. | 2,740 | 2,960 | 2,574 |
| $H_2$ partial pressure at reaction condition, psig | 1,750 | 1,643 | 1,600 |
| $H_2$ consumption, mmol/mmol benzothiophene | 2.98 | 2.52 | 3.06 |
| Sulphur removal, wt. % | 94.6 | 88.8 | 94.7 |
| $H_2S$ production, mmol/mmol benzothiophene | 0.49 | 0.39 | 0.58 |
| Emulsion breaking | Yes | Yes | Yes |

The results of Table 7 show that molybdic acid is slightly more active for desulphurization that ammonium molybdate. The activity of molybdic acid for desulphurization is similar to that of PMA.

SUMMARY OF DISCLOSURE

In summary of this disclosure, the present invention provides a novel means of upgrading crude oil emulsions to achieve essentially sulphur- and nitrogen-free lighter hydrocarbons. Modifications are possible within the scope of this invention.

What we claim is:

1. A process for treating stable hydrocarbonaceous oil emulsions, which comprises breaking said stable hydrocarbonaceous oil emulsion by reacting said stable hydrocarbonaceous oil emulsion with hydrogen in the presence of at least one compound or complex of a metal of Group VI B and Group VIII B of the Periodic Table of Elements so as to form an aqueous phase and a separate oil phase, whereby said emulsion breaking is effected without any prior emulsion treatment and/or separation step.

2. The process of claim 1 wherein said hydrocarbonaceous oil emulsion contains heavy crude oil and said treatment simultaneously yields an oil phase containing products of lower boiling point than the oil in said emulsion and which are essentially sulphur and nitrogen-free.

3. The process of claim 2 wherein said metal compound or complex is employed in an amount of about 50 to about 22,500 wppm, calculated as elemental metal, based on the emulsion.

4. The process of claim 3 wherein said metal compound or complex is employed in an amount of from about 2500 to about 5500 wppm, calculated as elemental metal, based on the emulsion.

5. The process of claim 3 wherein said metal compound or complex comprises an inorganic metal compound, an organic metal salt, a metal carbonyl, a metal inorganic salt, an inorganic acid, a salt of an inorganic acid, or an inorganic oxide.

6. The process of claim 5 wherein said metal compound or complex is phosphomolybdic acid or molybdic acid.

7. The process of claim 5 wherein said metal compound or complex is molybdenum hexacarbonyl or tungsten hexacarbonyl.

8. The process of claim 5 wherein said metal compound or complex is iron sulphate heptahydrate or ammonium molybdate.

9. The process of claim 2 which is effected at a temperature of about 300° C. to about 450° C., at a total reaction pressure of about 1500 to about 5000 psig and at a hydrogen partial pressure of about 750 to about 2500 psig.

10. The process of claim 9 wherein said reaction is effected at a temperature of about 310° C. to about 360° C., at a total reaction pressure of about 1800 to about 3000 psig and at a hydrogen partial pressure of about 850 to about 2000 psig.

11. The process of claim 2 wherein said hydrogen is produced in situ by the water-gas-shift reaction between carbon monoxide and the aqueous phase of said emulsion.

12. The process of claim 2 wherein said hydrogen is provided at least partly from external sources and said metal compound or complex is phosphomolybdic acid.

13. A single stage process for the simultaneous breaking and upgrading of hydrocarbonaceous oil emulsions wherein the oil comprises a heavy crude oil containing up to about 8 wt. % sulphur and up to about 5 wt. % nitrogen, which comprises:

(a) introducing to the hydrocarbonaceous oil emulsion at least one compound or complex of a metal of Group VI B or Group VIII B of the Period Table of Elements in an amount of from about 50 to about 22,500 wppm, calculated as elemental metal, based on the emulsion, to form a mixture;

(b) pressurizing said mixture of emulsion and metal compound or complex with a gas comprising carbon monoxide to an initial CO loading of about 200 to about 1000 psig and heating the mixture to a reaction temperature of about 300° to about 450° C.;

(c) producing hydrogen in situ by the water-gas-shift reaction between the carbon monoxide and the aqueous phase of the emulsion and reacting the emulsion with the in situ-produced hydrogen in the presence of catalytically-active species derived from said metal compound or complex at a total reaction pressure of about 1500 to about 5000 psig and a hydrogen partial pressure of about 750 to about 2500 psig; and (d) recovering an aqueous phase and an oil phase wherein the oil phase contains hydrocarbonaceous oil of lower boiling point than said heavy crude oil and essentially sulphur- and nitrogen-free, whereby breaking of the emulsion is effected without the necessity for prior treatment and/or chemicals.

14. The process of claim 13 wherein said reaction is effected at a temperature of about 310° to about 360° C., a total reaction pressure of about 1800 to about 3000 psig and at a hydrogen partial pressure of about 850 to about 2000 psig.

15. The process of claim 13 wherein said hydrocarbonaceous oil emulsion containing a naturally-occurring hydrocarbonaceous feedstock which is a heavy crude oil, well head bitumen, slop feed, asphatenes or a refinery residual oil.

16. The process of claim 13 wherein said hydrocarbonaceous oil emulsion is a synthetic oil/water mixture resulting from an oil spill.

17. The process of claim 13 wherein said metal compound or complex is selected from organometallic compounds, inorganic metal compounds, isopoly- and heteropoly-acids and their salts and salts of organic acids.

18. The process of claim 17 wherein the metal constituent of said metal compound or complex is selected from molybdenum, tungsten and iron.

19. The process of claim 17 wherein said metal compound or complex is selected from a metal carbonyl, a metal naphthenate and a hydrated metal sulphate salt.

20. The process of claim 13 wherein said metal compound or complex is phosphomolybdic acid.

21. The process of claim 13 wherein said metal compound or complex is molybdic acid.

22. The process of claim 13 wherein said metal compound or complex is molybdenum hexacarbonyl or tungsten hexacarbonyl and said process is effected under alkaline conditions.

23. The process of claim 13 wherein said metal compound or complex is iron sulphate heptahydrate.

24. The process of claim 13 wherein said metal compound or complex is ammonium molybdate.

25. The process of claim 13 wherein said metal compound or complex is used in an amount of from about 2500 to about 5500 wppm, calculated as elemental metal, based on the emulsion.

26. The process of claim 13 wherein a single metal compound or complex is employed as a precursor for the catalytic species, whereby said catalytic species catalyzes both the water-gas shift reaction and the upgrading of the hydrocarbonaceous oil without the need of a second metal compound or complex.

27. A process for breaking a stable hydrocarbonaceous oil emulsion, which comprises generating hydrogen in situ in an aqueous hydrocarbonaceous oil emulsion in the presence of at least one compound or complex of a metal of Group VI B and Group VIII B of the Periodic Table of Elements so as to effect breaking of the emulsion into an aqueous phase and a separate oil phase, whereby said emulsion breaking is effected without any prior emulsion treatment and/or separation step.

28. The process of claim 27 wherein said metal compound, complex is $Mo(CO)_6$, $W(CO)_6$, phosphomolybdic acid or Mo naphthenate or molybdic acid.

29. The process of claim 28 wherein said process is effected at a temperature of about 100° to about 400° C.

30. The process of claim 29 wherein said process is effected at a pressure of about 350 to about 4000 psig.

31. The process of claim 27 wherein said hydrogen is generated in situ by the water-gas-shift reaction between carbon monoxide and the aqueous phase of the emulsion.

* * * * *